US005493368A

United States Patent [19]

Nishio

[11] Patent Number: 5,493,368

[45] Date of Patent: Feb. 20, 1996

[54] IMAGE FORMING APPARATUS THAT COPIES BOTH TWO-DIMENSIONAL IMAGES FACED DOWNWARD AND THREE-DIMENSIONAL OBJECTS FACED UPWARD

[75] Inventor: Tomonori Nishio, Kanagawa, Japan

[73] Assignee: Fuji Photo Film Co., Ltd., Kanagawa, Japan

[21] Appl. No.: 306,316

[22] Filed: Sep. 15, 1994

[30] Foreign Application Priority Data

Sep. 20, 1993 [JP] Japan ..... 5-233576
Mar. 18, 1994 [JP] Japan ..... 6-049078

[51] Int. Cl.[6] ..... G03G 21/00

[52] U.S. Cl. ..... 355/230; 354/80; 355/75

[58] Field of Search ..... 355/67, 75, 228, 355/230, 232, 233; 354/80, 292

[56] References Cited

U.S. PATENT DOCUMENTS 4,390,267 6/1983 Minor ..... 355/228
4,454,210 6/1984 Ariyama et al. ..... 354/80 X

*Primary Examiner*—William J. Royer
*Attorney, Agent, or Firm*—Sughrue, Mion, Zinn, Macpeak & Seas

[57] ABSTRACT

An image forming apparatus for producing a copy image by scanning and exposing an image, including a three-dimensional object onto a photosensitive surface, of a photosensitive material. The apparatus includes an original placing table on which an original with a planar image recorded thereon is placed, with the planar image facing the original placing table; a first scanning exposure device for scanning and exposing the original placed on the original placing table; a three-dimensional object placing table for placing a three-dimensional object thereon; a second scanning exposure device for scanning the three-dimensional object from above; and an optical device for guiding the images scanned by the first scanning exposure device and the second scanning exposure device onto the photosensitive surface of the photosensitive material. The first scanning exposure device exposes and scans a planar image, the second scanning exposure device exposes and scans a three-dimensional object, and the optical device guides light from different optical paths (optical paths from the first scanning exposure device and the second scanning exposure device) onto the photosensitive surface of the photosensitive material. Accordingly, it is possible to copy both a two-dimensional image whose surface to be copied may be faced downward and a liquid-containing three-dimensional object (foods, beverages, and water tanks) whose surface to be copied must be faced upward.

24 Claims, 8 Drawing Sheets

IMAGE FORMING APPARATUS THAT COPIES BOTH TWO-DIMENSIONAL IMAGES FACED DOWNWARD AND THREE-DIMENSIONAL OBJECTS FACED UPWARD

BACKGROUND OF THE INVENTION

1. Field of the Invention

The present invention relates to an image forming apparatus for forming a reproduced image by scanning and exposing an image, including a three-dimensional object, and forming an image directly on a photosensitive surface of a photosensitive material. The image is then transferred onto an image receiving material.

2. Description of the Related Art

Image forming apparatuses are known in which the processing of image recording is effected by using two types of image recording material, including a photosensitive material and an image receiving material.

The photosensitive material and the image receiving material are respectively taken up in roll form and are accommodated in magazines having their interiors shielded from light, and are used by being consecutively pulled out each time the processing of image recording is effected. In addition, a water application section is disposed in the image recording apparatus for applying an image-forming solvent onto the photosensitive material after exposure. Further, a heat development transfer section, which is comprised of a heat drum and an endless pressure-contact belt for pressure contacting an outer periphery of the heat drum and rotating together with the heat drum, is also disposed in the image recording apparatus.

Further, with the image recording apparatus of this type, a placing table for placing an original thereon is provided on the upper surface of the apparatus. The placing table is formed of a transparent glass plate, and a holding cover which is superposed on the transparent glass plate.

The holding cover can be opened. After an original is placed on the transparent glass plate with the holding cover set in an open state, the holding cover is closed. Consequently, the original can be held in a predetermined position.

The photosensitive material is pulled out from the magazine by a predetermined length and cut. While the photosensitive material is being nipped and transported by transport rollers, an image of the original placed on the transparent glass plate is exposed by an optical system. After water serving, as an image-forming solvent, is applied to the photosensitive material in the water application section, the photosensitive material is sent to the heat development transfer section. Meanwhile, the image receiving material is pulled out by a predetermined length from the magazine and is cut in the same way as the photosensitive material. The image receiving material is also sent to the heat development transfer section by transport rollers in synchrony with the photosensitive material. In the heat development transfer section, the photosensitive materials, to which water has been applied, are superposed on the image receiving material. These superposed materials are wound around the outer periphery of the heat drum in close contact therewith. Further, while these two materials are being nipped and transported by the heat drum and the endless pressure-contact belt, the photosensitive material undergoes heat development, and an image is transferred onto the image receiving material, thereby allowing a predetermined image to be formed (recorded) on the image receiving material.

However, the above structure and process suffice if the image to be copied is a two-dimensional image recorded on paper. However, in a case where there arises a need to copy a three-dimensional object, special conditions are required in that the three-dimensional object must be placed upside down, the focusing plane must be raised, and the background must be whitened by means of back light.

In addition, with the above-described structure, since it is essential to cause the copying surface to face downward, it is impossible to copy a three-dimensional object containing a liquid, in particular. Namely, the structure is such that it is impossible to copy planar images of such items as foods, beverages, and water tanks.

Although an apparatus for copying a three-dimensional object by photographing the three-dimensional object from above is available, and it is possible to copy a three-dimensional object containing a liquid by using such an apparatus, since the apparatus is an exclusive-use apparatus, the arrangement of the apparatus is complicated, and lacks versatility.

SUMMARY OF THE INVENTION

Accordingly, in view of the above-described circumstances, it is an object of the present invention to provide an image forming apparatus which has a simple structure, is highly versatile, and is capable of copying two-dimensional images and three-dimensional objects containing a liquid irrespective of the type of the object to be copied.

In accordance with a first aspect of the present invention, there is provided an image forming apparatus for producing a copy image by scanning and exposing an image, including a three-dimensional object, onto a photosensitive surface of a photosensitive material. The apparatus comprises: an original placing table on which an original with a planar image recorded thereon is placed with the planar image facing the original placing table; a first scanning exposure device for scanning and exposing the original placed on the original placing table; a three-dimensional object placing table for placing a three-dimensional object thereon; a second scanning exposure device for scanning the three-dimensional object from above; and an optical device for guiding the images scanned by the first scanning exposure device and the second scanning exposure device onto the photosensitive surface of the photosensitive material.

In accordance with a second aspect of the present invention, in the image forming apparatus in accordance with the first aspect of the present invention, the second scanning exposure device is provided in such a manner as to be selectively movable to a position at which the three-dimensional object placed on the three-dimensional object placing table and outside the apparatus can be scanned.

In accordance with a third aspect of the present invention, there is provided an image forming apparatus for producing a copy image by scanning and exposing an image, including a three-dimensional object, onto a photosensitive surface of a photosensitive material. The apparatus comprises: a placing table having a transparent plate-like first placing portion on which an original with a planar image recorded thereon is placed with the planar image facing the first placing portion, and a second placing portion for placing a three-dimensional object thereon; a first scanning exposure device for scanning and exposing the original placed on the placing table; a second scanning exposure device for scanning the three-dimensional object from above; and an optical device for guiding the images scanned by the first scanning exposure device and the second scanning exposure device onto the photosensitive surface of the photosensitive material.

In accordance with a fourth aspect of the present invention, the image forming apparatus in accordance with the third aspect of the present invention further comprises: a support member for supporting the second scanning exposure device such that the second scanning exposure device is capable of approaching and moving away from the second placing portion; a positioning device for positioning the second scanning exposure device to a focusing position of the three-dimensional object placed on the second placing portion; and a driving device for changing a position where the second scanning exposure device is supported.

In accordance with a fifth aspect of the present invention, the image forming apparatus in accordance with the fourth aspect of the present invention further comprises: an indicator portion which is moved in correspondence with the position where the second scanning exposure device is supported by the positioning device, and which indicates the focusing position located in a space between the second scanning exposure device and the second placing portion.

In accordance with the first aspect of the present invention, in the case of a planar image (a two-dimensional image recorded on paper or the like), the original is placed on the original placing table with the image surface facing the original placing table, the image scanned by the first scanning exposure device, and the image is guided onto the photosensitive surface of the photosensitive material by the optical device. Consequently, an image is formed on the photosensitive surface of the photosensitive material, and after the image is subsequently transferred onto the image receiving material, a copied image can be obtained.

Meanwhile, in a case where a three-dimensional object, particularly a three-dimensional object containing a liquid, is copied, the three-dimensional object is placed on the three-dimensional object placing table with the surface to be copied facing upward. The image is scanned by the second scanning exposure device, and the image is guided onto the photosensitive surface of the photosensitive material by the optical device.

The optical device is capable of guiding light from different optical paths (optical paths from the first scanning exposure device and the second scanning exposure device) onto the photosensitive surface of the photosensitive material. Accordingly, it is possible to copy both a two-dimensional image whose surface to be copied may be faced downward and a liquid-containing three-dimensional object (foods, beverages, and water tanks) whose surface to be copied must be faced upward.

It is possible to use a movable mirror as the optical device. Namely, as the image scanned and exposed by the first scanning exposure device, or the second scanning exposure device, is selectively guided by the movable mirror onto the photosensitive surface of the photosensitive material, the optical paths of the optical device (and leading therefrom) can be used in common, so that it is possible to obtain a highly versatile image forming apparatus.

In addition, it is possible to use a half mirror as the optical device. Namely, if one of the images scanned and exposed by the first scanning exposure device and the second scanning exposure device is reflected by the half mirror, and the other one of the images is transmitted therethrough, the moving operation of the mirror becomes unnecessary.

In accordance with the second aspect of the present invention, the second scanning exposure device is provided in such a manner as to be selectively movable to a position at which the three-dimensional object placed on the three-dimensional object placing table and outside the apparatus can be scanned. Where a large-sized three-dimensional object which cannot be placed on the three-dimensional object placing table is scanned, the large-sized three-dimensional object is placed outside the apparatus (e.g., on the side of the apparatus), and the position of the second scanning exposure device is moved from above the three-dimensional object placing table in such a manner as to permit scanning at that position.

Thus, since the position of the second scanning exposure device can be selected, it is possible to reliably effect scanning and obtain a copied image irrespective of the type of three-dimensional object (size, weight, fluid objects, etc.).

In accordance with the third aspect of the present invention, for instance, an original with a planar image recorded thereon is placed on the first placing portion formed by a transparent plate (e.g., a glass plate). Meanwhile, a three-dimensional object is placed on the second placing portion, and this second placing portion has a portion in common with the first placing portion. Namely, when a planar image is scanned, since the surface of the first placing portion is a focusing position, scanning is effected from below via the transparent plate. When a three-dimensional object is scanned, the second placing portion is used merely as a placing surface, and the focusing position is present in a spatial position above the second placing portion.

Thus, by jointly using the placing positions of a planar image and a three-dimensional object, it is possible to make the apparatus compact.

It should be noted that, in order to prevent the transparent plate from becoming damaged, a cover surface for holding the planar image together with the transparent plate may be used as the second placing portion.

In accordance with the fourth aspect of the present invention, the second scanning exposure device is supported by a support member, and the second scanning exposure device is made capable of approaching and moving away from (e.g., moving vertically with respect to) the second placing portion. The change in the position (distance from the second placing portion) of the second scanning exposure device is proportional to the change in the focusing position, so that the interval between the second scanning exposure device and the second placing portion can be widened or shortened by the positioning device, and the focusing position can be thereby altered, in correspondence with the change in the height of the three-dimensional object.

Accordingly, it is easily possible to adjust the focusing position to an uppermost portion of the three-dimensional object, and to set the focusing position not only to the uppermost portion but also to a desired heightwise position.

In accordance with the fifth aspect of the present invention, when the position where the second scanning exposure device is supported is altered by the positioning device, since the focusing position is present in the space between the second scanning exposure device and the second placing portion, it is difficult to ascertain the focusing position accurately. Accordingly, it becomes easy to ascertain the focusing position if the indicator portion is always made to indicate the focusing position by moving the indicator portion in correspondence with a change in the position where the second scanning exposure device is supported.

As the indicator portion, the focusing position may be indicated by an arrow, with a scale inscribed in advance, and with a pointer moved on the scale. Alternatively, a light beam may be illuminated onto a side surface of the apparatus which corresponds to the focusing position, or a shadow may be projected onto the side surface to indicate the focusing position.

Furthermore, the focusing position may be displayed in terms of a distance from a predetermined position on the second placing portion or the second scanning exposure device. In this case, if the aforementioned scale is jointly used, it suffices to read the scale on the basis of the reading on the display so as to ascertain the focusing position.

As described above, the image forming apparatus in accordance with the present invention offers an outstanding advantage in that the apparatus has a simple structure, is highly versatile, and is capable of copying two-dimensional images and three-dimensional objects containing a liquid, irrespective of the type of object to be copied.

The above and other objects, features and advantages of the present invention will become more apparent from the following detailed description of the invention when read in conjunction with the accompanying drawings.

DESCRIPTION OF THE PREFERRED EMBODIMENTS

Figure 1:
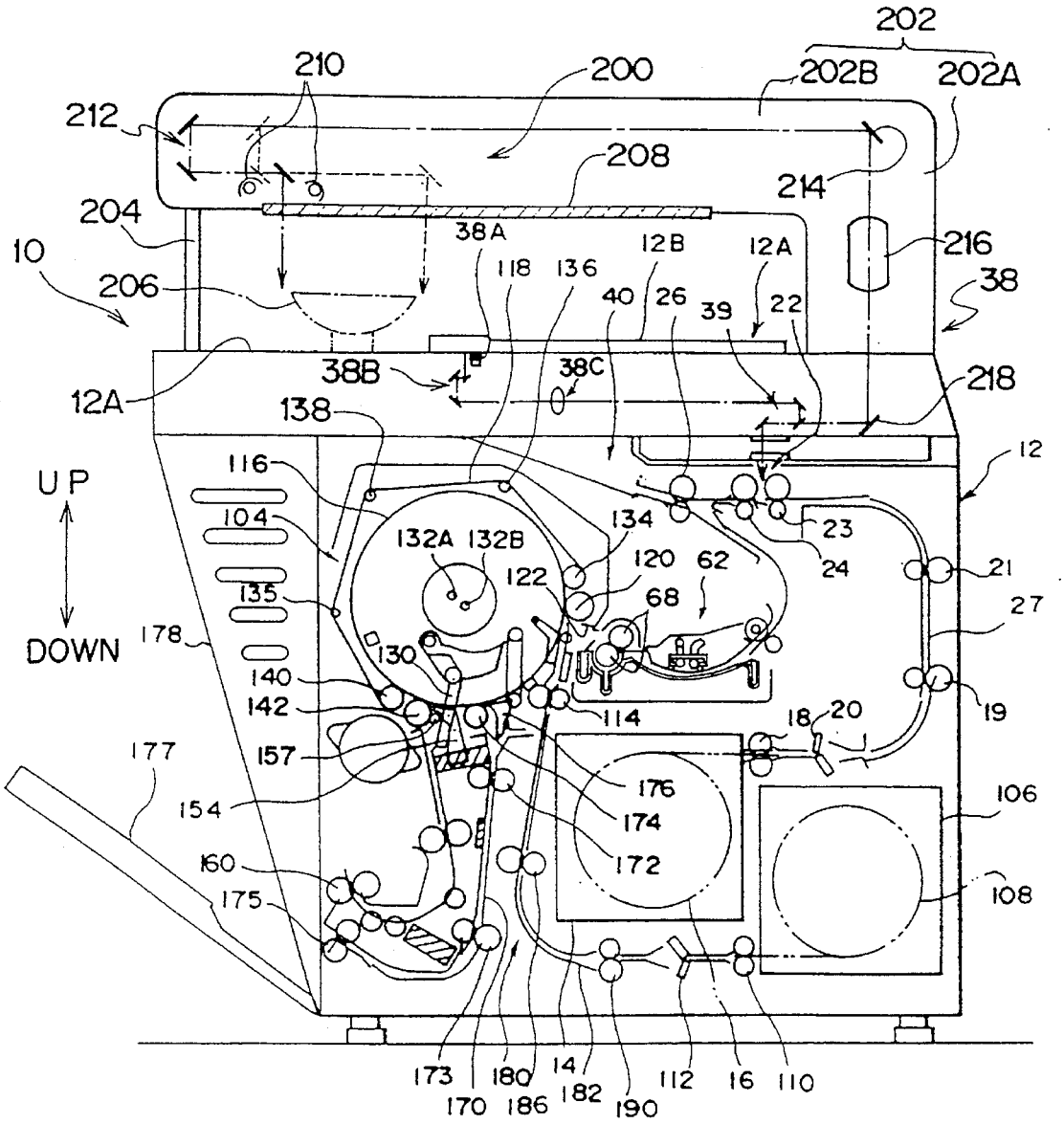
FIG. 1 is an overall schematic diagram of an image recording apparatus in accordance with a first embodiment of the present invention.

In all the embodiments of the present invention which are described hereafter, the term UP in the drawings indicates the upward direction, and the term DOWN indicates the downward direction.

Figure 2:
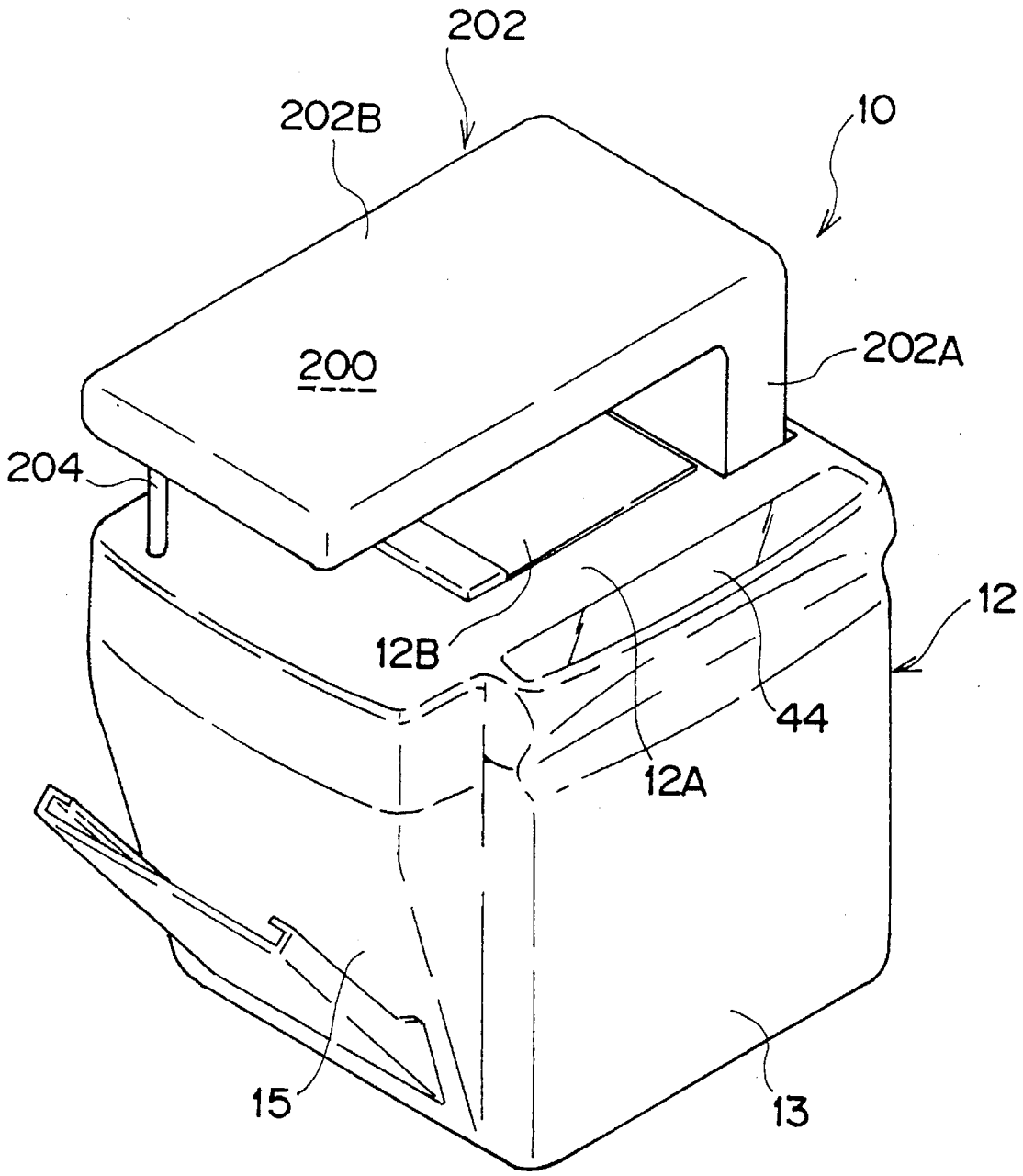
FIG. 2 is a perspective view illustrating an external view of the image recording apparatus in accordance with the first embodiment.

FIG. 1 shows an overall schematic diagram of an image recording apparatus 10 in accordance with a first embodiment of the present invention. FIG. 2 shows an external view of the image recording apparatus 10.

The image recording apparatus 10 as a whole is structured in the shape of a box, and has a machine stand 12, provided with a front door 13, and a side door 15. As each door is opened, the interior of the machine stand 12 can be exposed.

In addition, a placing table 12A for placing an original 42 (see FIG. 3) thereon is provided on an upper surface of the machine stand 12 of the image recording apparatus 10. A holding cover 12B, which may be opened to about the farther side of the apparatus, is provided on the placing table 12A. An operation panel 44 is disposed on the upper surface of the machine stand 12.

A transparent glass plate 12C (see FIG. 3) is attached to the placing table 12A, and the original 42 is placed on the transparent glass plate 12C. After the original 42 is positioned, if the holding cover 12B is closed, the original will be held in a predetermined position. Namely, this original 42 has a planar image (two-dimensional image) recorded on paper or the like, and the placing table 12A is used when a planar image is copied.

As shown in FIG. 1, a photosensitive material magazine 14 is disposed within the machine stand 12 of the image recording apparatus 10, and a photosensitive material 16 is accommodated therein after being taken up in the form of a roll. This photosensitive material 16 is taken up with its photosensitive (exposure) surface facing the shaft for taking up the photosensitive material 16.

A pair of nip rollers 18 and a cutter 20 are disposed in the vicinity of a photosensitive material paying-out port of the photosensitive material magazine 14 so that the photosensitive material 16 can be cut after a predetermined length thereof has been paid out from the photosensitive material magazine 14.

A plurality of transport rollers 19, 21, 23, 24, and 26 and a guide plate 27 are disposed downstream of the cutter 20 along a transport passage, so that the photosensitive material 16, cut to a predetermined length, can be transported to an exposure section 22.

The exposure section 22 is located between the transport rollers 23 and the transport rollers 24 so as to form an exposure portion (exposure point) which is between these transport rollers and through which the photosensitive material 16 passes.

Figure 3:
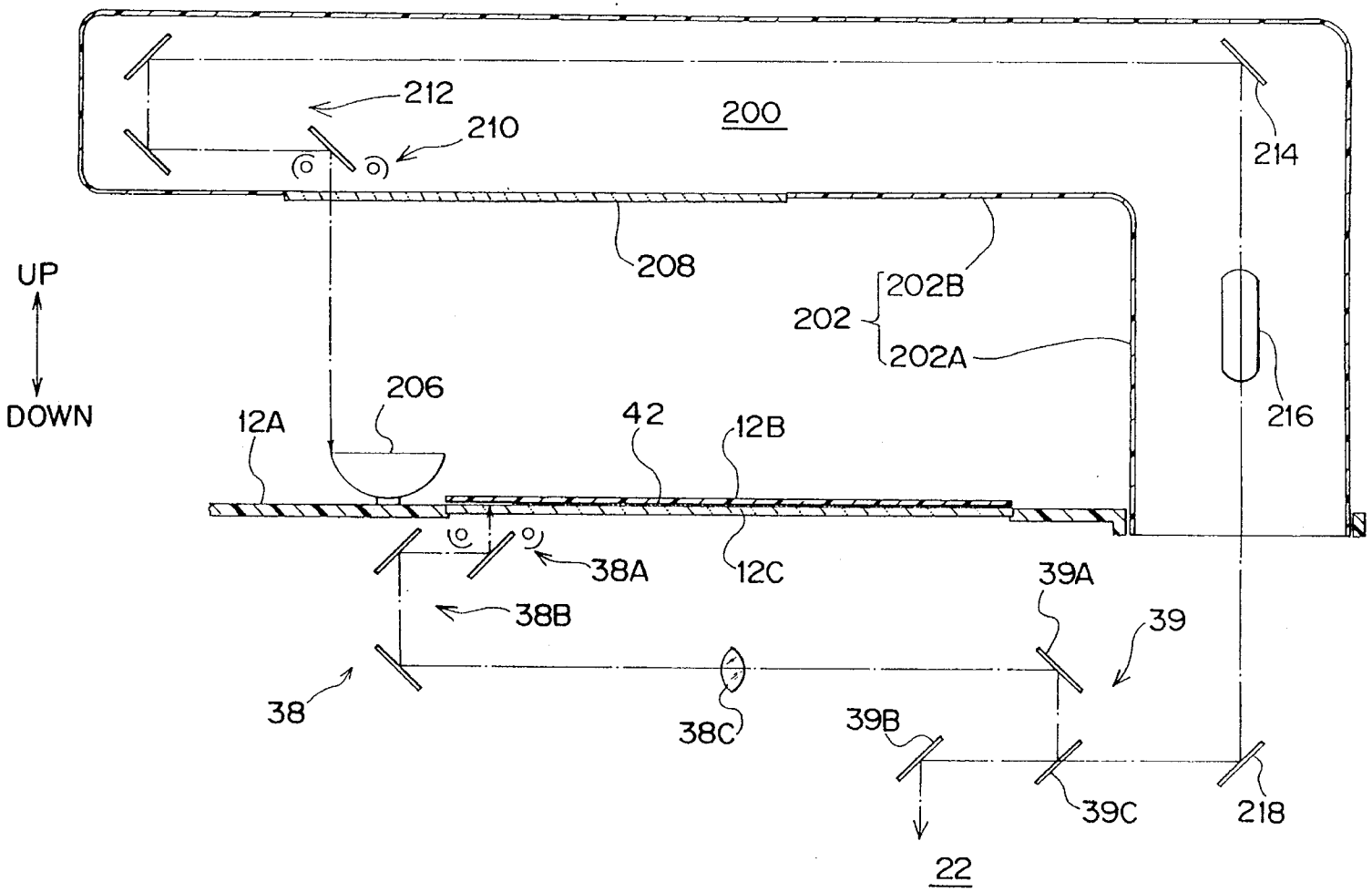
FIG. 3 is an enlarged view of optical systems of first and second exposure devices in accordance with the first embodiment.

As shown in FIG. 3, a first exposure device 38 for exposing a planar image is provided in a space above the exposure section 22 and below the transparent glass plate 12C. Disposed in the first exposure device 38 are halogen lamps 38A, a mirror unit 38B, and a lens unit 38C which are moved horizontally below the transparent glass plate 12C, a mirror unit 39 for guiding the scanned/exposed light to the exposure section 22, and a filter and a diaphragm which are not shown.

As shown in FIG. 3, in this first embodiment, the mirror unit 39 is comprised of two total reflection mirrors 39A, 39B and one half mirror 39C. An optical path (in a horizontal direction) from the mirror unit 38B is bent substantially orthogonally (in a vertically downward direction) by the total reflection mirror 39A, is reflected and bent substantially perpendicularly (in a horizontal direction) by the half mirror 39C, and is bent substantially perpendicularly (in a vertically downward direction) by the total reflection mirror 39B, so as to guide the light to the exposure section 22.

As shown in FIG. 1, a sub-casing 202, in which a second exposure device 200 for copying a three-dimensional object is incorporated, is disposed above the placing table 12A. The sub-casing 202, when seen from the front side of the apparatus, is formed in a substantially L-shaped configuration, and a proximal portion of an upright section 202A is detachably mounted on a right-hand end portion of the placing table 12A shown in FIG. 1. In addition, a distal end portion of a horizontal section 202B is supported on the placing table 12A by means of a guide rod 204. A clearance is formed between the placing table 12A and the underside of the horizontal section 202B by the portion of the length of the guide rod 204, and this clearance provides a space for placing a three-dimensional object 206.

The underside of the horizontal section 202B has a rectangular opening where a transparent glass plate 208 is attached. The transparent glass plate 208 is opposed to the the placing table 12A and the holding cover 12B in an area ranging from a position on the surface of the placing table 12A corresponding to one end of the transparent glass plate 208 to a position on the surface of the holding cover 12B corresponding to another end thereof. Namely, the surface of the placing table 12A (including the holding cover 12B) is used as a supporting base for the three-dimensional object 206.

The second exposure device 200 in the sub-casing 202 is comprised of halogen lamps 210 and a mirror unit 212 which are moved horizontally above the transparent glass plate 208, a mirror 214 for bending the light scanned and exposed by the mirror unit 212 in a vertically downward direction along the upright section 202A, a lens unit 216, a mirror 218 for bending the light passing through the lens unit 216 toward the half mirror 39C of the mirror unit 39, and the like.

By means of this second exposure device 200, the three-dimensional object 206 placed on the placing table 12A is scanned and exposed from above, and its light is transmitted through the half mirror 39C and is guided to the exposure section 22. That is, it is possible to copy the three-dimensional object 206 containing a liquid.

Figure 4:
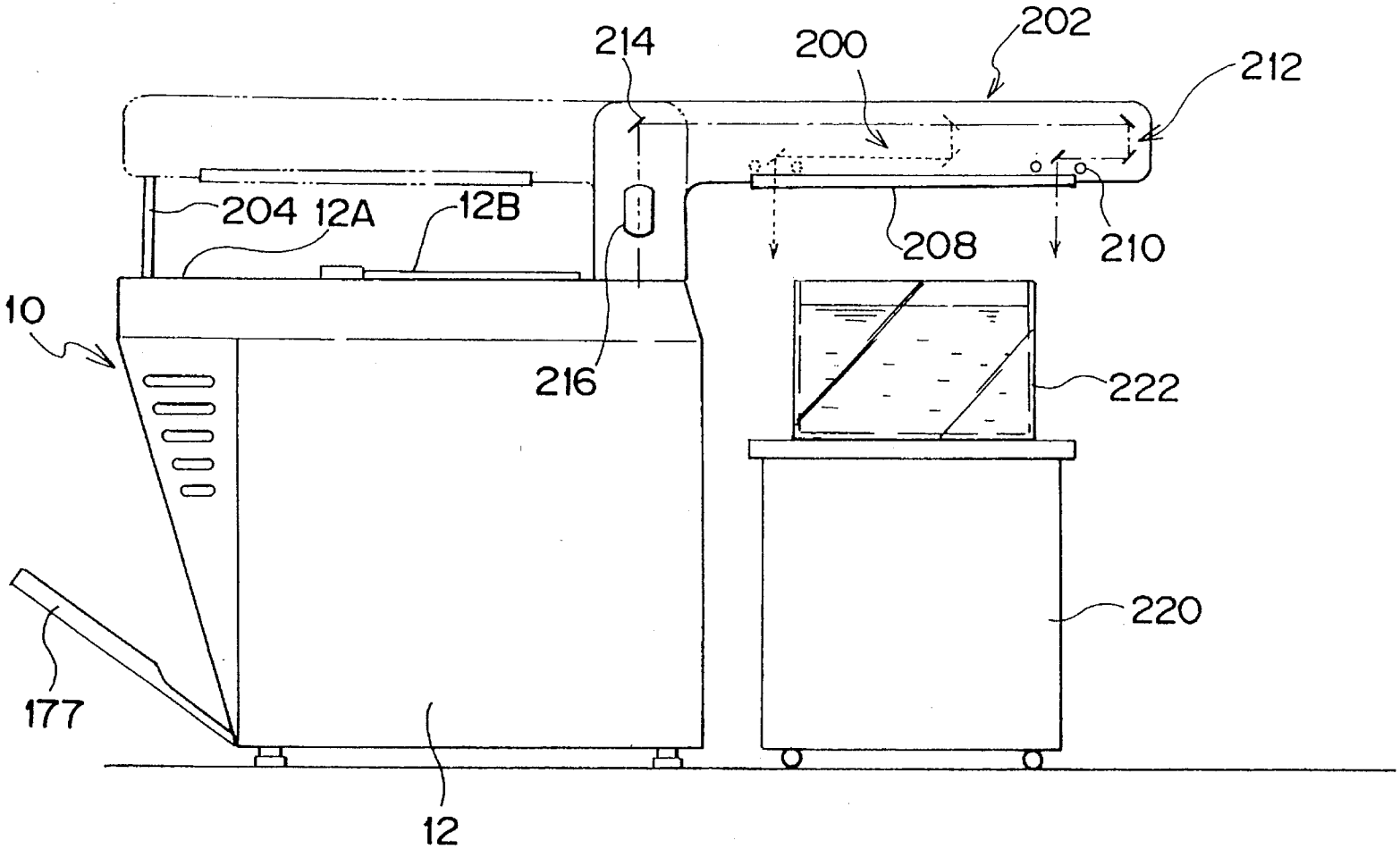
FIG. 4 is a front elevational view illustrating a state in which the second exposure device, in accordance with the first embodiment, is mounted.

The sub-casing 202 can be selectively attached at a first position (the state in FIG. 1) where the sub-casing 202 is positioned above the placing table 12A and at a second position (see the solid lines in FIG. 4) where the sub-casing 202 is rotated 180° with respect to the first position. In the second position, it is possible to copy a three-dimensional object 222 placed on a receiving table 220 prepared on the side of the machine stand 12. Namely, it is possible to copy a large-sized three-dimensional object 222 which cannot be accommodated in the clearance between the placing table 12A and the underside of the sub-casing 202.

Thus, the image recording apparatus 10 in accordance with this first embodiment is provided with the first exposure device 38 for copying a planar image and the second exposure device 200 for copying the three-dimensional object 206 (222). A selecting switch (not shown) for selecting either one of the exposure devices to be used is provided on the operation panel 44, so that either exposure device can be selected at the discretion of the operator.

A switch back section 40 is provided on the side of the exposure section 22, and a water application section 62 is provided below the exposure section 22. The photosensitive material 16, which has been transported in such a manner as to rise upward in the vicinity of the side of the photosensitive material magazine 14 and has been exposed in the exposure section 22, is temporarily sent to the switch back section 40, and is then transported along a transport passage provided below the exposure section 22 and is sent to the water application section 62 as the transport rollers 26 are rotated reversely.

A plurality of pipes are connected to the water application section 62 so as to supply water.

A heat development transfer section 104 is disposed on the side of the water application section 62, to which the photosensitive material 16 with water applied thereto is sent.

Meanwhile, an image receiving material magazine 106 is disposed on the side of the photosensitive material magazine 14 within the machine stand 12, and an image receiving material 108 is accommodated therein after being taken up in the form of a roll. A pigment fixing material having a mordant has been applied to an image-forming surface of the image receiving material 108, and the image receiving material 108 has been taken up with the image-forming surface thereof facing a shaft for taking up the image receiving material 108.

The image receiving material magazine 106, like the photosensitive material magazine 14, is comprised of a trunk portion and a pair of side frame portions fixed to both ends of the trunk portion. The image receiving material magazine 106 can be pulled out toward a front surface side of the machine stand 12 (toward this side in FIG. 1, i.e., in the transverse direction of the taken-up image receiving material 108).

A pair of nip rollers 110 are disposed in the vicinity of an image receiving material paying-out port of the image receiving material magazine 106. The nip rollers 110 are capable of pulling out the image receiving material 108 from the image receiving material magazine 106 and of cancelling their nip. A cutter 112 is disposed on the side of the nip rollers 110.

An image receiving material transporting section 180 is provided on the side of the photosensitive material magazine 14. Transport rollers 186, 190, and 114 and guide plates 182 are disposed in the image receiving material transporting section 180, and the image receiving material 108 cut to a predetermined length can be transported to the heat development transfer section 104.

The photosensitive material 16 which is transported to the heat development transfer section 104 is fed into a nip between a laminating roller 120 and a heat drum 116. Meanwhile, the image receiving material 108 is also fed into the nip between the laminating roller 120 and the heat drum 116 in synchronism with the transport of the photosensitive material 16 in a state in which the image receiving material 108 is preceded by the photosensitive material 16 by a predetermined length, and is superposed on top of the photosensitive material 16.

A pair of halogen lamps 132A and 132B are disposed within the heat drum 116 and are capable of raising the temperature of the surface of the heat drum 116.

An endless pressure-contact belt 118 is trained around five training rollers 134, 135, 136, 138, and 140. The outer side of the endless pressure-contact belt 118 located between the training roller 134 and the training roller 140 is brought into pressure contact with the outer periphery of the heat drum 116.

A bending/guiding roller 142 is disposed downstream of the endless pressure-contact belt 118 in the transporting direction of the materials and on the lower side of the heat drum 116. A peeling claw 154 is disposed downstream of the bending/guiding roller 142 in the transporting direction of the materials and on the lower side of the heat drum 116, and is rotatably supported by a shaft.

The photosensitive material 16 peeled off by the peeling claw 154 is wound around the bending/guiding roller 142, and is accumulated in a waste photosensitive material accommodating box 178 by photosensitive material discharge rollers 160.

A peeling roller 174 and a peeling claw 176 are disposed in the vicinity of the heat drum 116 on the side of the bending/guiding roller 142. Disposed below the peeling roller 174 and the peeling claw 176 are an image receiving material guide 170, as well as image receiving material discharge rollers 172, 173, and 175, so that the image receiving material 108 peeled off the heat drum 116 by means of the peeling roller 174 and the peeling claw 176 can be guided and transported.

The image receiving material 108 peeled off from the outer periphery of the heat drum 116 by the peeling claw 176 is transported by the image receiving material guide 170 and the image receiving material discharge rollers 172, 173, and 175 and is discharged to a tray 177.

Next, a description will be given of the operation of the first embodiment.

In a case where the copying of a planar image is selected by the selecting switch on the operation panel 44, a sheet of paper with the planar image recorded thereon is placed on the transparent glass plate 12C with the image facing downward. After the holding cover 12B is closed, the magnification, the number of sheets to be processed, and the like are designated by operating switches on the operation panel 44. When an instruction of starting is given, image processing is commenced.

Namely, the nip rollers 18 are operated in a state in which the photosensitive material 16 is set in the photosensitive material magazine 14, and the photosensitive material 16 is pulled out by the nip rollers 18. When a predetermined length of the photosensitive material 16 is pulled out, the cutter 20 is actuated to cut the photosensitive material 16 to a predetermined length.

After the actuation of the cutter 20, the direction of travel of the photosensitive material 16 is inverted as the photosensitive material 16 is transported along the transport passage, and the photosensitive material 16 is transported to the exposure section 22 in a state in which its photosensitive (exposure) surface is faced upward. At the same time as the photosensitive material 16 is transported, the first exposure device 38 is operated so that the photosensitive material 16 positioned in the exposure section 22 is scanned and exposed. That is, the light from the first exposure device 38 is reflected by the half mirror 39C of the mirror unit 39, and is guided to the exposure section 22 by the total reflection mirror 39B.

After the exposure is started, the exposed photosensitive material 16 is temporarily sent to the switch back section 40, and is then sent to the water application section 62 by the reverse rotation of the transport rollers 26.

In the water application section 62, water is applied to the photosensitive material 16, and the photosensitive material 16 passes through the water application section 62 while excess water is being removed by a pair of squeeze rollers 68.

The photosensitive material 16, to which water serving as an image-forming solvent is applied in the water application section 62, is sent to the heat development transfer section 104 by the squeeze rollers 68.

Meanwhile, as the scanning and exposure of the photosensitive material 16 is started, the image receiving material 108 is pulled out from the image receiving material magazine 106 by the nip rollers 110 and is transported. When a predetermined length of the image receiving material 108 is pulled out, the cutter 112 is actuated to cut the image receiving material 108 to a predetermined length.

After the actuation of the cutter 112, the image receiving material 108 is transported by the transport rollers 190, 186, and 114 while being guided by the guide plate 182, and is set on standby immediately before the heat development transfer section 104.

In the heat development transfer section 104, when it is detected that the photosensitive material 16 has been fed into a nip between the outer periphery of the heat drum 116 and the laminating roller 120 by the squeeze rollers 68, the transport of the image receiving material 108 is resumed and the image receiving material 108 is fed into the nip between the outer periphery of the heat drum 116 and the laminating roller 120. At the same time, the heat drum 116 is operated.

In this case, a guide plate 122 is disposed between the laminating roller 120 and the squeeze rollers 68 of the water application section 62, so that the photosensitive material 16 sent from the squeeze rollers 68 is guided reliably into the nip between the outer periphery of the heat drum 116 and the laminating roller 120.

The photosensitive material 16 and the image receiving material 108, which are superposed one on top of the other by the laminating roller 120, are nipped in the superposed state by the outer periphery of the heat drum 116 and the endless pressure-contact belt 118, and are transported substantially by two-thirds of the circumference (between the training roller 134 and the training roller 140) of the heat drum 116. As a result, the photosensitive material 16 and the image receiving material 108 are heated, so that mobile pigments are released, and the pigments are simultaneously transferred onto a pigment fixing layer of the image receiving material 108, thereby obtaining an image.

Subsequently, when the photosensitive material 16 and the image receiving material 108 are nipped and transported, and reach a lower portion of the heat drum 116, the peeling claw 154 is moved by a cam 130 into engagement with a leading end of the photosensitive material 16 which is being transported by preceding the image receiving material 108 by a predetermined length. Consequently, the leading end portion of the photosensitive material 16 is peeled off the outer periphery of the heat drum 116. Further, as the peeling claw 154 is returned, the photosensitive material 16 is pressed by a pinch roller 157. As a result, the photosensitive material 16 is wound around the bending/guiding roller 142 while being pressed by the pinch roller 157, is then moved downward, and is accumulated in the waste photosensitive material accommodating box 178.

Meanwhile, the image receiving material 108, which is separated from the photosensitive material 16 and moves in close contact with the heat drum 116, is fed into a nip between the outer periphery of the heat drum 116 and the peeling roller 174 so as to be peeled off the outer periphery of the heat drum 116.

The image receiving material 108, which is peeled off the outer periphery of the heat drum 116 by the peeling claw 176, is moved downward while being wound around the peeling roller 174, is transported by the image receiving material discharge rollers 172, 173, and 175 while being guided by the image receiving material guide 170, and is discharged to the tray 177.

In the case of a planar image (an image recorded on a sheet of paper), as described above, it is readily possible to copy the image by placing the image on the transparent glass plate 12C with the image facing downward. With the first exposure device 38, however, it is impossible to copy a three-dimensional object, particularly a three-dimensional object containing a liquid. Accordingly, to copy such a three-dimensional object, this apparatus is provided with the sub-casing 202 which incorporates the second exposure device 200.

When a three-dimensional object is copied, the operator selects the copying of a three-dimensional object by operating the selecting switch on the operation panel 44.

Next, in a case where the three-dimensional object to be copied is relatively small (the three-dimensional object 206 shown in FIG. 1), the three-dimensional object is placed on the placing table 12A. Incidentally, in the case of an elongated three-dimensional object, the object may be placed by extending it over the holding cover 12B.

Next, the magnification, the number of sheets to be processed, and the like are designated by operating the switches on the operation panel 44. When a start instruction is given, image processing is commenced, and the operation in the apparatus body is started in the same way as in the above-described copying of a planar image (the transport of the photosensitive material 16 and the like).

At the same time as the photosensitive material 16 is transported, the second exposure device 200 is operated, and the photosensitive material 16 positioned in the exposure section 22 is scanned and exposed. Namely, the light from the second exposure device 200 is transmitted through the half mirror 39C of the mirror unit 39, and is guided to the exposure section 22 by means of the total reflection mirror 39B.

Thereafter, since the exposure of the photosensitive material 16, the transfer of the image onto the image receiving material 108 and the like are similar to those in the case of the above-described copying of a planar image, a description thereof will be omitted.

Thus, due to the joint use of the first exposure device 38 and the second exposure device 200, it is possible to copy not only three-dimensional objects, but also various other images, so that the image recording apparatus 10 is a highly versatile image recording apparatus. Particularly, in the case of a three-dimensional object containing a liquid, an exclusive-use copying apparatus has been conventionally required. But since the second exposure device 200 is arranged in such a manner as to effect copying with the image facing upward, such a three-dimensional object containing a liquid can be copied easily. For instance, in cases where plan-view images of foods and beverages are to be incorporated in menus of restaurants and the like, it is unnecessary to attach photographic paper, photographed separately with a camera, to paper on which prices and the like are printed. Since the copied images, together with characters and symbols, can be recorded directly on the paper, the final product improves in terms of appearance as well. In addition, this image recording apparatus can be used effectively in the presentation of new merchandise and the like.

It should be noted that the sub-casing 202 incorporating the second exposure device 200, which is used in the first embodiment, is detachable with respect to the apparatus body. For instance, where a large-size three-dimensional object 222 (see FIG. 4) which cannot be placed on the placing table 12A is to be copied, the sub-casing 202 is mounted in a state in which the horizontal section 202B is rotated 180° from the state shown in FIG. 1 (see the solid lines in FIG. 4). In this state, if the large-size three-dimensional object 222 is placed on the receiving table 220 (or directly on the apparatus-mounting floor) which is disposed on the side of the machine stand 12, the three-dimensional object 222 can be copied by the second exposure device 200.

Figure 5:
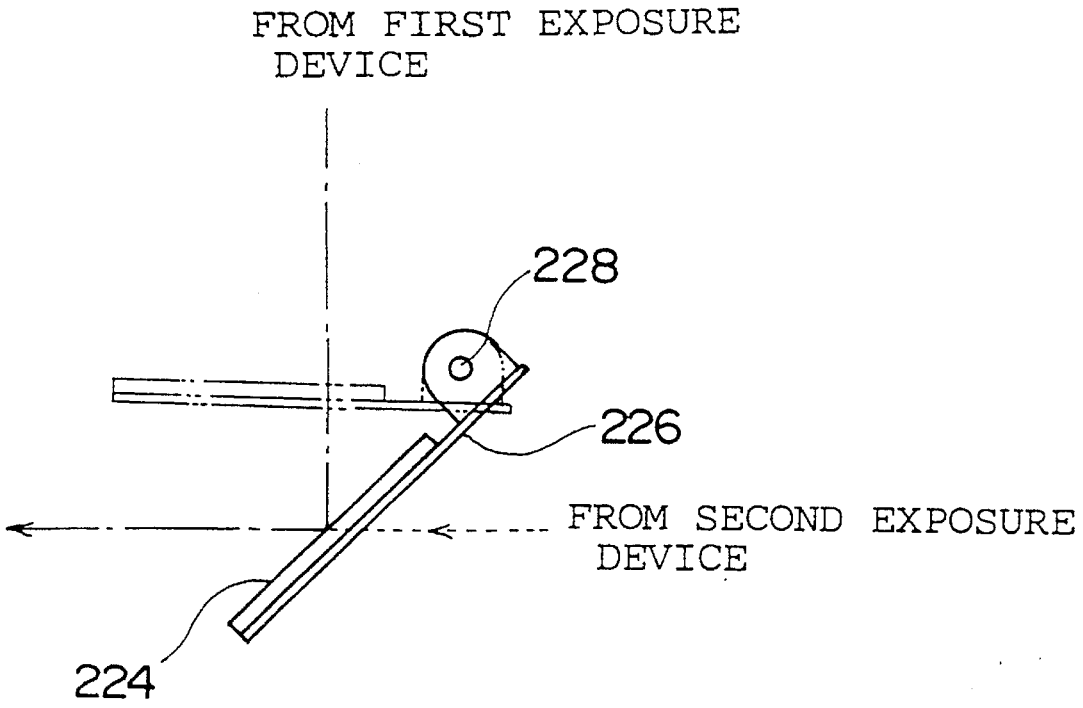
FIG. 5 is an enlarged view of a mirror unit section illustrating a modification of an optical device for selectively guiding the light from the first and second exposure device in accordance with the first embodiment to an exposure section.

Although, in the first embodiment, optical axes of the light from the first exposure device 38 and the light from the second exposure device 200 leading to the exposure section 22 are aligned with each other by means of the half mirror 39C, an arrangement may be provided as shown in FIG. 5. Namely, instead of the half mirror, a total reflection mirror 224 fixed to a bracket 226 is disposed in such a manner as to be rotatable approximately 45° about a shaft 228, so that the total reflection mirror 224 is movable between a position (solid-line position) in which the light from the first exposure device 38 is deflected 90° and a position (phantom-line position) in which the total reflection mirror 224 does not interfere with the light from the second exposure device 200. Incidentally, the movement of the total reflection mirror 224 may be interlocked with the selecting switch on the operation panel 44.

Hereafter, a description will be given of a second embodiment of the present invention. In this second embodiment, the component parts which are identical to those of the first embodiment will be denoted by the same reference numerals, and a description thereof will be omitted.

The characteristic feature of this second embodiment lies in that a mechanism is added for causing the second exposure device 200, which is a second scanning exposure means, to approach and move away from the placing table 12A when the second exposure device 200 is located above the placing table 12A.

Figure 6:
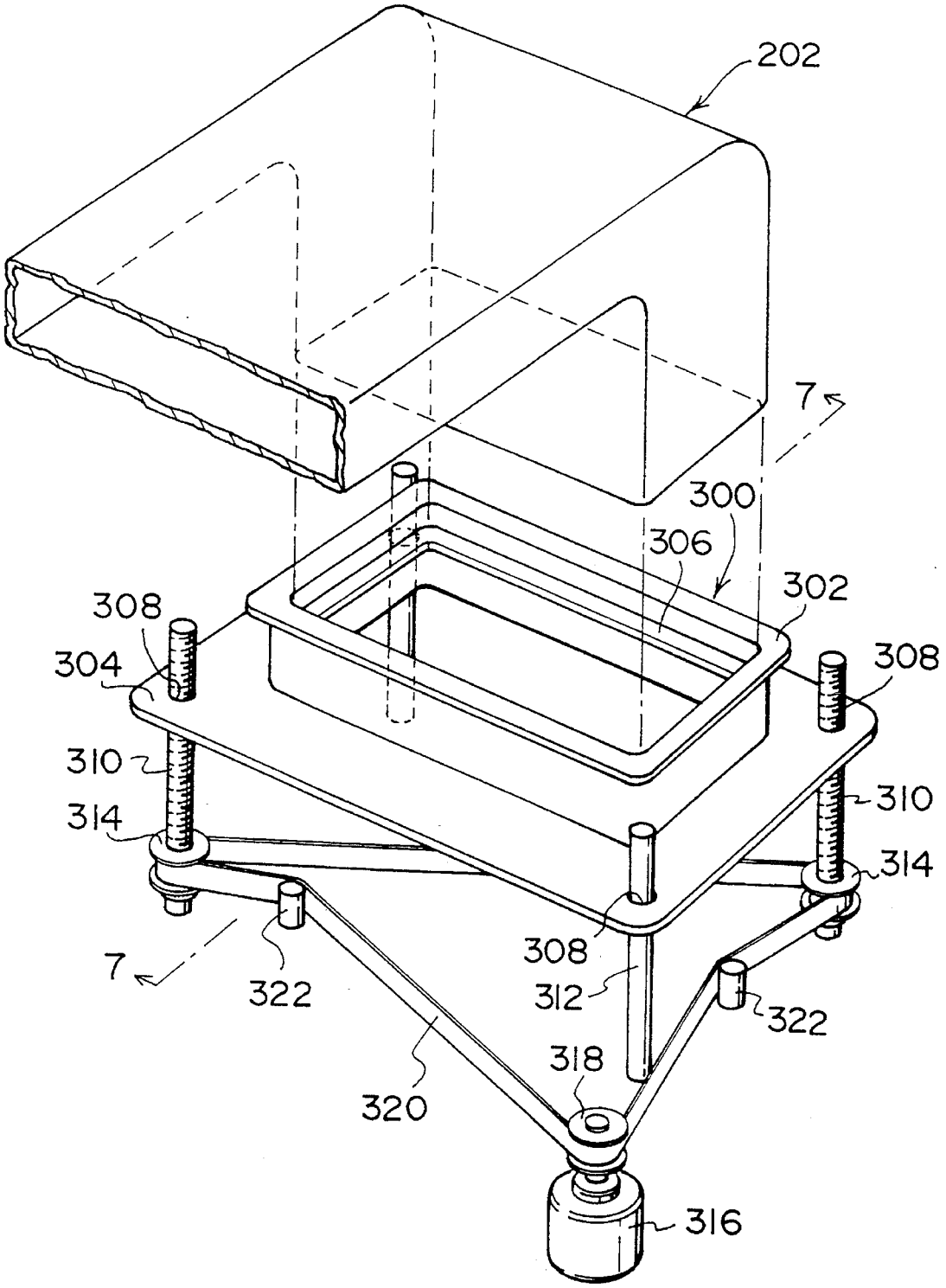
FIG. 6 is a perspective view for illustrating a mechanism for vertically moving the second exposure device in accordance with a second embodiment.
Figure 7:
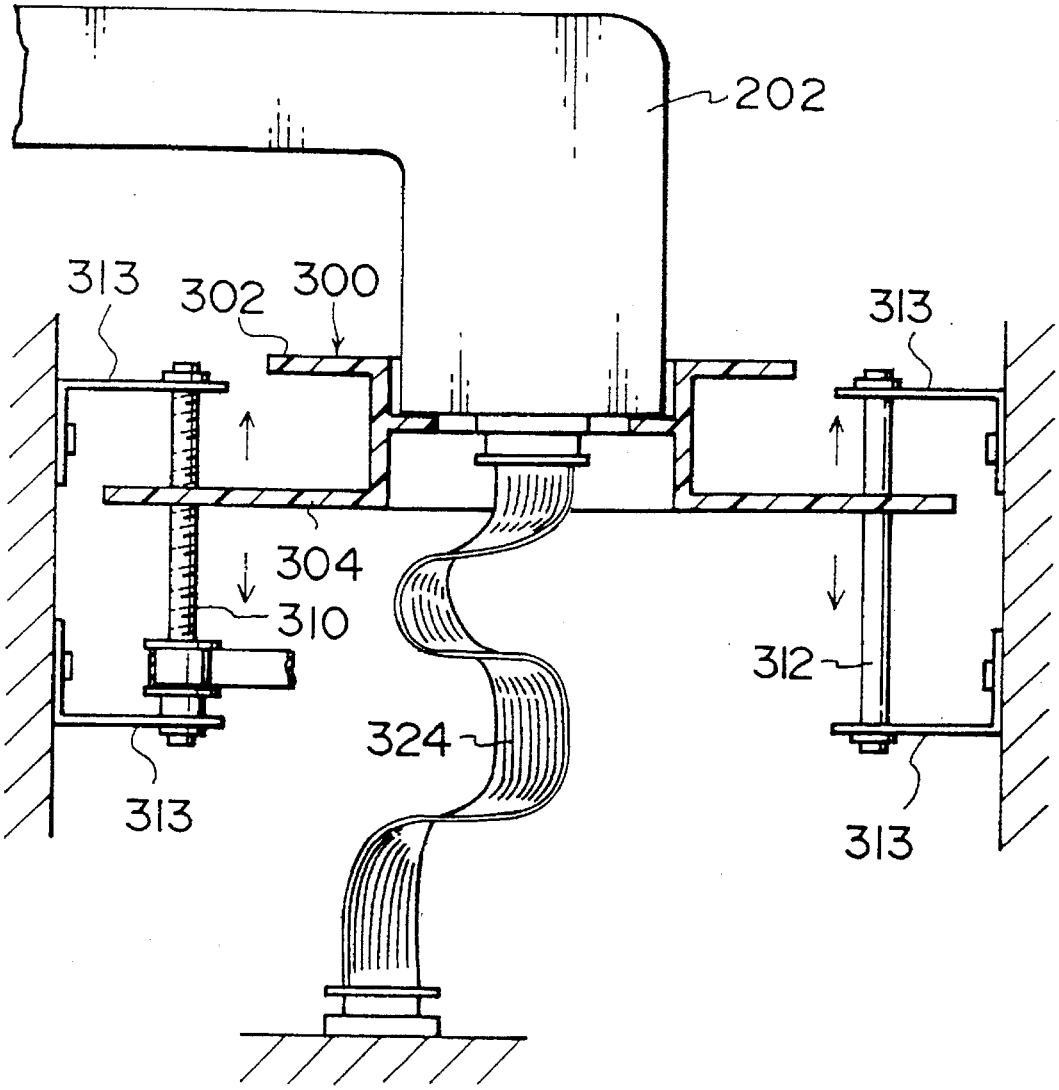
FIG. 7 is a cross-sectional view taken along line 7—7 in FIG. 6.

As shown in FIGS. 6 and 7, a support casing 300 is disposed at a position where the sub-casing 202 is mounted on the apparatus body. The support casing 300 is shaped like a frame whose inward upper and lower surfaces are open. A first flange 302 is formed at upper edges thereof and is located at peripheral edges of a rectangular hole provided in the placing table 12A, so as to prevent the support casing 300 from falling down. In addition, a second flange 304 having a size larger than the first flange 302 is formed at a lower end of the support casing 300.

A rib 306 is formed on inner peripheral surfaces of the support casing 300 on four sides thereof, and a lower end of the sub-casing 202 is supported on an upper surface of the rib 306.

Circular holes 308 are provided in vicinities of four corners of the second flange 304 (only three circular holes 308 are shown in FIG. 6), and internal threads are formed on the inner peripheries of the circular holes 308 located on one diagonal line. An externally threaded shaft 310 is threadedly engaged in each of the circular holes 308 having the internal threads formed therein, and shafts 312 are inserted in the other circular holes 308, respectively. Upper and lower end portions of the externally threaded shafts 310 and the shafts 312 are axially supported by L-shaped brackets 313 (see FIG. 7), respectively, and are fixed to the apparatus body by means of the L-shaped brackets 313.

A flanged pulley 314 is attached to a lower end portion of each of the externally threaded shafts 310.

An endless belt 320 is trained around these pulleys 314 and a pulley 318 is attached to a rotating shaft of a motor 316. Tension rollers 322 for adjusting the tension of the belt 320 are provided at two positions on the belt 320, and are moved in a direction orthogonal to the axis thereof, as necessary, so as to adjust the tension.

Here, when the motor 316 is driven, the externally threaded shafts 310 are rotated by a rotating force of the motor 316 by means of the belt 320, so that the support casing 300 is moved while being guided by the shafts 312. Consequently, the sub-casing 202 supported on the support casing 300 is moved vertically.

Due to this vertical movement, the interval between the transparent glass plate 208 of the sub-casing 202 and the placing table 12A is widened or shortened, and can be varied in accordance with the height of the three-dimensional object 206 placed on the placing table 12A.

At this time, since the focusing position becomes twice the amount of vertical movement of the sub-casing 202, the adjustment of the focusing position becomes possible in a wide range.

As shown in FIG. 7, the wiring of a harness 324, in which signal lines for scanning and exposing are bundled, needs to be provided in the sub-casing 202 from the apparatus body side. In this second embodiment, the harness 324 is formed by a flexible member, so that even if the heightwise position of the sub-casing 202 is changed, the change can be coped with by the deformation of the harness 324 itself, as shown in FIG. 7.

Figure 8:
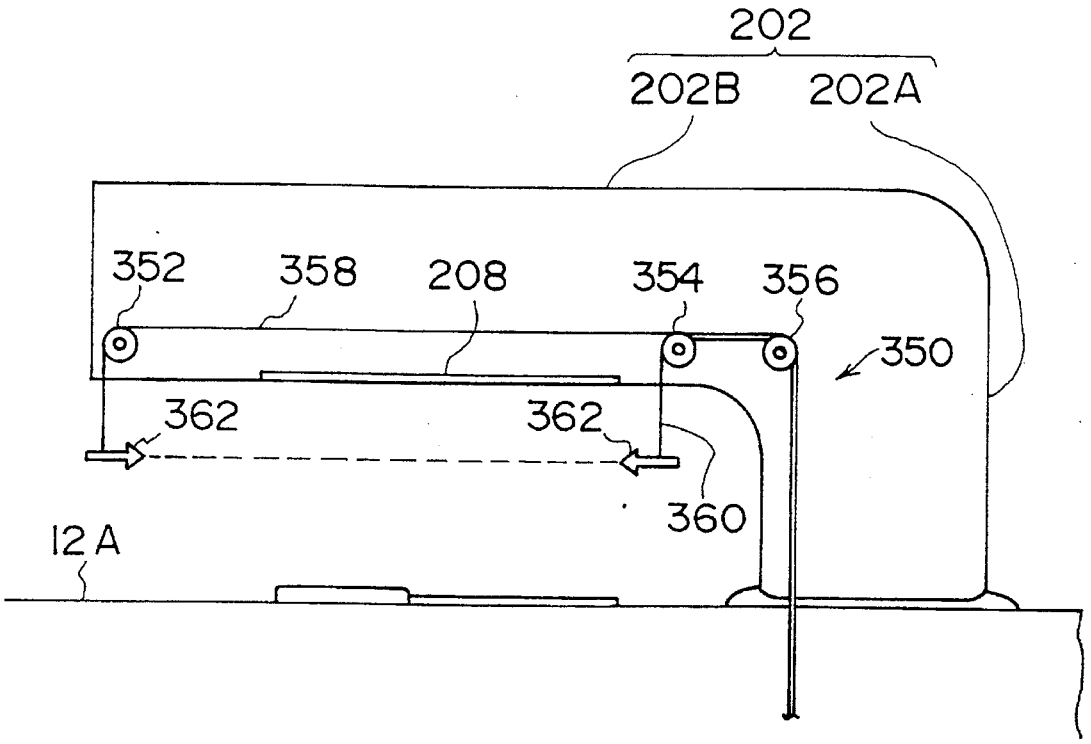
FIG. 8 is a side elevational view illustrating the arrangement of an indicator portion provided in a sub-casing.

FIG. 8 shows an indicator section 350 for indicating a focusing position. The indicator section 350 is comprised of three pulleys 352, 354, and 356 provided in the sub-casing 202, two wires 358 and 360 wound around these pulleys 352, 354, and 356, and pointers 362 attached to ends of the wires 358 and 360, respectively.

The pulleys 352 and 354 are disposed at an extreme projecting end of the horizontal section 202B of the sub-casing 202 and a proximal portion of the horizontal section 202B for connection with the upright section 202A, respectively. The pulley 356 is disposed on an extension of a line connecting the pulleys 352 and 354 in the upright section 202A of the sub-casing 202.

One end of the two wires 358 and 360 are respectively passed through the support casing 300, and are retained at a vertically nonmovable portion within the apparatus body. The two wires 358 and 360 are wound by approximately 90° around the pulley 356 disposed in the upright section 202A. One wire 358 extends to the pulley 352 disposed in the extreme projecting end in the horizontal section 202B of the sub-casing 202, is wound by approximately 90° around the pulley 352, and is suspended therefrom. The other wire 360 extends to the pulley 354 disposed in the proximal portion of the horizontal section 202B of the sub-casing 202, is wound by approximately 90° around the pulley 354, and is suspended therefrom.

The pointers 362 shaped in the form of arrows whose directions are opposed to each other are attached to the lower ends of the suspended wires 358 and 360, respectively. The pointers 362 are arranged such that their heights can always be maintained at the same level.

When the support casing 300 is moved vertically by the driving force of the motor 316, and the sub-casing 202 is thereby moved vertically, the wires 358 and 360 are respectively moved in their axial directions by means of the pulleys 352, 354, and 356, so that the pointers 362 are moved vertically.

Since these wires 358 and 360 respectively have two portions where they move axially in the vertical direction, the amount of vertical movement of the wires 358 and 360 becomes twice the amount of vertical movement of the sub-casing 202, and becomes equivalent to the amount of movement of the focusing position. For this reason, once the position of the pointer 362 is set to the focusing position with the sub-casing 202 set to a certain heightwise position, the pointers 362 are subsequently capable of indicating the focusing position at all times.

Hereafter, a description will be given of the operation of the second embodiment.

In a case where the three-dimensional object 206 placed on the placing table 12A is scanned and exposed, although there is a certain degree of focal depth, a three-dimensional object having a very small thickness and a three-dimensional object whose upper surface reaches up to a close vicinity of the transparent glass plate 208 of the sub-casing 202 cannot be focused. In this case, therefore, in the apparatus of the first embodiment, it is necessary to detach the sub-casing 202 and move it to the second position, and it is necessary to adjust the focusing position after the receiving table 220 having an appropriate height is placed on the side of the machine stand 12.

In this second embodiment, however, a three-dimensional object which can be placed in the space between the placing table 12A and the transparent glass plate 208 of the sub-casing 202 is placed on the placing table 12A.

Here, if the motor 316 is driven, the rotating force of the motor 316 is transmitted to the externally threaded shafts 310 by means of the belt 320, so that the externally threaded shafts 310 are axially rotated.

The rotation of the externally threaded shafts 310 causes the support casing 300 to move vertically, with the result that the sub-casing 202 is also moved vertically.

Next, after the scanning height (e.g., an uppermost end) of the three-dimensional object is determined, the heightwise position of the sub-casing 202 is adjusted until the pointers 362 come to be positioned at that scanning height. At this time, since the amount of movement of the pointers 362 becomes twice the amount of heightwise adjustment of the sub-casing 202, the focusing position can be varied in a relatively large range.

At a point of time when the position of the pointers 362 is aligned with the scanning height of the three-dimensional object, the driving of the motor 316 is stopped, and scanning and exposure is started. Since the procedure during and after the scanning and exposure is identical to that of the first embodiment, a description thereof will be omitted.

Thus, in accordance with the second embodiment, since the sub-casing 202 is made vertically movable, the types (shape, height, etc.) of three-dimensional objects which can be scanned and exposed on the placing table 12A widen. In particular, three-dimensional objects having very small thicknesses (a liquid such as soup contained in a dish, solids such as beads whose positions are not fixed) and three-dimensional objects whose upper surfaces reach up to a close vicinity of the transparent glass plate 208 of the sub-casing 202 (flowers arranged in a vase or the like) can be scanned and exposed simply. In addition, since the focusing position can be altered freely, and the focusing position can be visually confirmed, heightwise varied portions of the same three-dimensional object can be scanned and exposed without moving the three-dimensional object.

Although, in this embodiment, the sub-casing 202 is arranged to be vertically movable, three-dimensional objects which cannot be scanned above the placing table 12A can be scanned by setting the horizontal section 202B in a 180° rotated state in the same way as in the first embodiment.

Although, in this embodiment, the driving force of the motor 316 is used as the means for vertically moving the support casing 300, and the externally threaded shafts. 310 are rotated by means of the belt 320 (i.e., a ball screw system), the support casing may be moved vertically by the rotation of an eccentric cam. Alternatively, the support casing 300 may be attached to extending/retracting rods of air cylinders (hydraulic cylinders). Further, an arrangement may be provided such that a plurality of grooves are provided in the machine stand 12 or the support casing 300 as in the adjustment of the height of a shelf board, so as to manually change the heightwise position of the support casing 300 selectively.

In addition, although, in this embodiment, the indicator section 350 is comprised of the pulleys 352, 354, and 356, the wires 358 and 360, and the pointers 362, an arrangement may be provided as follows. The heightwise position of the sub-casing 202 is detected by a sensor or the like, the focusing position is calculated on the basis of the result of detection by the sensor, and a light beam is illuminated onto a scale inscribed in advance on a side surface of the upright section 202A of the sub-casing 202. Further, a shadow, instead of the light beam, may be projected onto the scale. Moreover, the result of calculation may be displayed as a numerical value on a display panel, and the operator may read the scale by using the numerical value as a reference.

What is claimed is:

1. An image forming apparatus for producing a copy image by scanning and exposing an image including a three-dimensional object thereof onto a photosensitive surface of a photosensitive material, said apparatus comprising:

a placing table on which an original with one of a planar image recorded thereon and a three-dimensional object is placed;

a scanning exposure device for scanning and exposing the original placed on said placing table and scanning and exposing the three-dimensional object from above; and an optical device for guiding the image scanned by said scanning exposure device onto the photosensitive surface of the photosensitive material.

2. An image forming apparatus according to claim 1, wherein said placing table has an original placing portion for placing the original thereon with the planar image facing said original placing portion.

3. An image forming apparatus according to claim 2, wherein said placing table has a three-dimensional object placing portion for placing the three-dimensional object thereon.

4. An image forming apparatus according to claim 1, wherein said scanning exposure device has a first scanning exposure device for scanning and exposing the original placed on said placing table.

5. An image forming apparatus according to claim 4, wherein said first scanning exposure device scans and exposes the original via an original placing portion provided on said placing table.

6. An image forming apparatus according to claim 4, wherein said scanning exposure device has a second scanning exposure device provided independently of said first scanning exposure device so as to scan and expose the three-dimensional object from above.

7. An image forming apparatus according to claim 6, further comprising:

a moving device for moving said second scanning exposure device so as to vary an interval between said second scanning exposure device and a three-dimensional object placing portion.

8. An image forming apparatus according to claim 7, further comprising:

an indicator portion which is moved in correspondence with a position of said second scanning exposure device being moved by said moving device, said indicator portion indicating a focusing position located in a space between said second scanning exposure device and said three-dimensional object placing portion.

9. An image forming apparatus for producing a copy image by scanning and exposing an image including a three-dimensional object onto a photosensitive surface of a photosensitive material, said apparatus comprising:

an original placing table on which an original with a planar image recorded thereon is placed with the planar image facing said original placing table;

a first scanning exposure device for scanning and exposing the original placed on said original placing table;

a three-dimensional object placing table for placing a three-dimensional object thereon;

a second scanning exposure device for scanning the three-dimensional object from above; and an optical device for guiding one or more images scanned by said first scanning exposure device and said second scanning exposure device onto the photosensitive surface of the photosensitive material.

10. An image forming apparatus according to claim 9, wherein said second scanning exposure device is provided in such a manner as to be selectively movable to a position at which the three-dimensional object placed on said three-dimensional object placing table and outside said apparatus can be scanned.

11. An image forming apparatus according to claim 9, wherein said optical device has a movable mirror for selectively guiding one of the images scanned and exposed by said first scanning exposure device and said second scanning exposure device onto the photosensitive surface of the photosensitive material.

12. An image forming apparatus according to claim 9, wherein said optical device has a half mirror which reflects one of the images scanned and exposed by said first scanning exposure device and said second scanning exposure device and allows another one thereof to be transmitted therethrough.

13. An image forming apparatus according to claim 9, wherein said first scanning exposure device scans and exposes the original via said original placing table.

14. An image forming apparatus according to claim 13, wherein said original placing table is formed of a material through which light, by which scanning and exposure is effected by said first scanning exposure device, can be transmitted.

15. An image forming apparatus for producing a copy image by scanning and exposing an image including a three-dimensional object onto a photosensitive surface of a photosensitive material, said apparatus comprising:

a placing table having a transparent plate-like first placing portion on which an original with a planar image recorded thereon is placed with the planar image facing said first placing portion, and a second placing portion for placing a three-dimensional object thereon;

a first scanning exposure device for scanning and exposing the original placed on said placing table;

a second scanning exposure device for scanning the three-dimensional object from above; and an optical device for guiding one or more images scanned by said first scanning exposure device and said second scanning exposure device onto the photosensitive surface of the photosensitive material.

16. An image forming apparatus according to claim 15, further comprising:

a support member for supporting said second scanning exposure device such that said second scanning exposure device is capable of approaching and moving away from said second placing portion;

a positioning device for positioning said second scanning exposure device to a focusing position of the three-dimensional object placed on said second placing portion; and a driving device for changing a position where said second scanning exposure device is supported.

17. An image forming apparatus according to claim 16, further comprising:

an indicator portion which is moved in correspondence with the position where said second scanning exposure device is supported by said positioning device, said indicator portion indicating the focusing position located in a space between said second scanning exposure device and said second placing portion.

18. An image forming apparatus according to claim 17, further comprising:

an indicator-portion moving member for moving said indicator portion in correspondence with the position where said second scanning exposure device is supported.

19. An image forming apparatus according to claim 18, wherein said indicator-portion moving member has one end fixed outside said second scanning exposure device and another end fixed to said indicator portion.

20. An image forming apparatus according to claim 16, wherein said positioning device has a threadedly engaging member for threadedly engaging said support member, and said threadedly engaging member vertically moves said support member as said threadedly engaging member rotates.

21. An image forming apparatus according to claim 20, wherein said positioning device has a transmitting member for transmitting a driving force of said driving device to said threadedly engaging member by converting the driving force of said driving device to a rotating force of said threadedly engaging member.

22. An image forming apparatus according to claim 21, wherein said transmitting member is an endless belt-shaped member.

23. An image forming apparatus according to claim 15, wherein said optical device has a movable mirror for selectively guiding one of the images scanned and exposed by said first scanning exposure device and said second scanning exposure device onto the photosensitive surface of the photosensitive material.

24. An image forming apparatus according to claim 15, wherein said optical device has a half mirror which reflects one of the images scanned and exposed by said first scanning exposure device and said second scanning exposure device and allows another one thereof to be transmitted therethrough.

* * * * *